US006519868B1

(12) United States Patent
Pryor et al.

(10) Patent No.: US 6,519,868 B1
(45) Date of Patent: Feb. 18, 2003

(54) ADJUSTABLE VISUAL MEDIA MOUNTING

(76) Inventors: John D Pryor, 1407 Main St., Alton, IL (US) 62002; Myronna Pryor, 1407 Main St., Alton, IL (US) 62002

( * ) Notice: Subject to any disclaimer, the term of this patent is extended or adjusted under 35 U.S.C. 154(b) by 0 days.

(21) Appl. No.: 09/752,995

(22) Filed: Dec. 30, 2000

(51) Int. Cl.[7] ..... G01B 3/04; A47G 1/06; A47G 1/16; G09F 7/18

(52) U.S. Cl. ..... 33/832; 33/485; 33/759; 40/757; 40/725; 248/476; 248/221.12

(58) Field of Search ..... 33/832, 483, 484, 33/485, 492, 494, 755, 759, 760; D10/70, 71; 40/725, 757, 759; 248/476, 221.12, 222.14

(56) References Cited

U.S. PATENT DOCUMENTS

| | | | | | |
|---|---|---|---|---|---|
| 1,974,085 | A | | 9/1934 | Shields et al. | |
| 2,215,884 | A | * | 9/1940 | Runge | 33/512 |
| 2,410,696 | A | * | 11/1946 | Wheeler | 33/832 |
| D192,384 | S | * | 3/1962 | Weigel | D10/71 |
| 3,507,045 | A | * | 4/1970 | Rives | D10/71 |
| 4,118,868 | A | | 10/1978 | Johnson | |
| D260,974 | S | * | 9/1981 | Lesser | D10/70 |
| 4,495,702 | A | * | 1/1985 | Bergstedt | 33/512 |
| D279,358 | S | * | 6/1985 | Lichtman | D10/71 |
| 4,603,828 | A | | 8/1986 | Farley, Jr. et al. | |
| D390,871 | S | | 2/1998 | Whitney | |
| 5,996,240 | A | | 12/1999 | Casper | |
| 6,073,359 | A | * | 6/2000 | Lee | 33/832 |

FOREIGN PATENT DOCUMENTS

| | | | | | |
|---|---|---|---|---|---|
| GB | 2244334 | B | * | 7/1991 | 33/759 |

* cited by examiner

*Primary Examiner*—Diego Gutierrez
*Assistant Examiner*—Stanley J. Pruchnic, Jr.
(74) *Attorney, Agent, or Firm*—Bruce E. Burdick

(57) ABSTRACT

A photographic mounting system correlates photographs with height by providing a vertically mountable ruler configured to adjustably receive and hold photograph frames at various adjustably selected heights on the ruler. The frames, in turn, hold the photographs, thus allowing placement of the photographs at selected heights on the ruler. Various locking mechanisms are disclosed to secure the frames to the ruler and prevent inadvertent or unauthorized removal. Also disclosed is a virtual equivalent of the physical system, the virtual equivalent having a greater variety of possible modifications and a greater amount of information linked to various growth indicia.

15 Claims, 3 Drawing Sheets

ADJUSTABLE VISUAL MEDIA MOUNTING

CROSS REFERENCE TO RELATED APPLICATIONS

This is an original application.

STATEMENT REGARDING FEDERALLY SPONSORED RESEARCH & DEVELOPMENT

This invention is NOT the subject of any government contract or government funding.

BACKGROUND OF THE INVENTION

The invention relates to a method of mounting pictures and a mounting system for pictures.

People like to keep photographs of various stages of growth of their children. These pictures are usually kept by age. People sometimes keep records of the height of their children, and one such record is a series of lines on a doorframe to indicate the date a child reached a certain height. Reliably correlating pictures or other visual media to height, either in addition to age or independently of age, is often difficult.

Therefore, it would be desirable to have a way of easily correlating photographs with the age of the photographic subject.

BRIEF SUMMARY OF THE INVENTION

In one exemplary embodiment, a photographic mounting system correlates photographs with height by providing a vertically mountable ruler is configured to adjustably receive and hold photograph frames at various heights on the ruler. The frames, in turn, hold the photographs, thus allowing placement of the photographs at selected heights on the ruler. In an alternate embodiment, the ruler and frames are virtual images on a computer display.

DETAILED DESCRIPTION OF THE INVENTION

Figure 1:
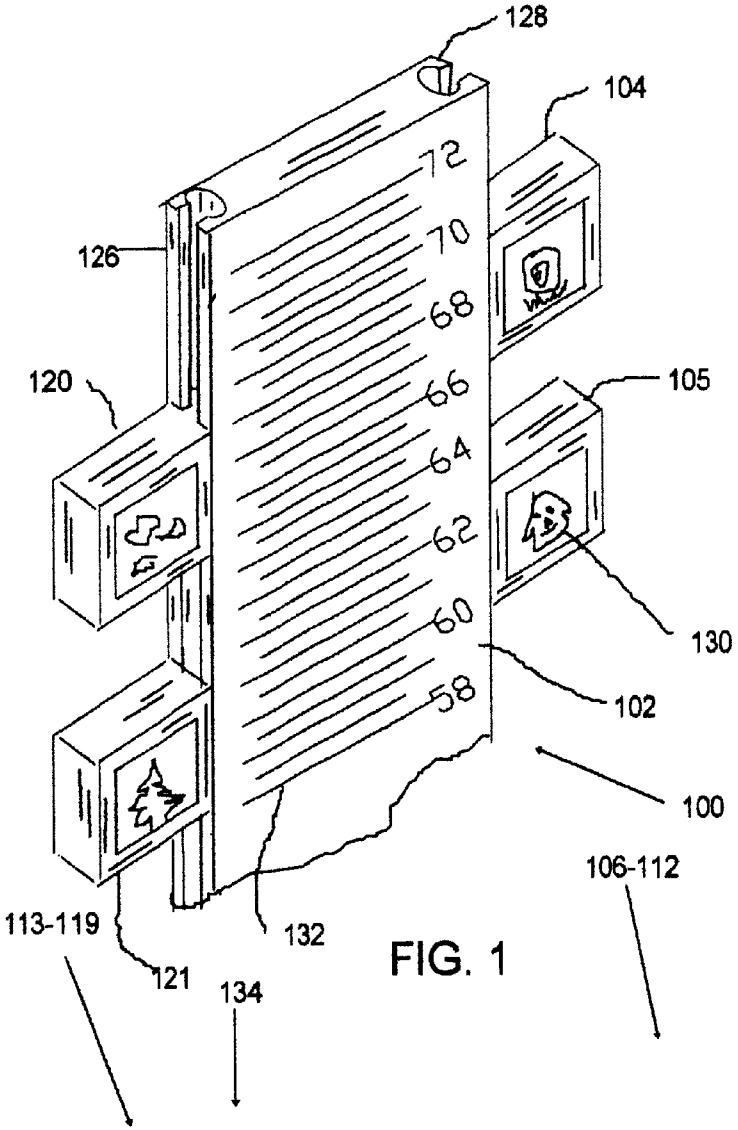
FIG. 1 is a front view of an adjustable wall mounting system for photographs.

FIG. 1 is a front view of an adjustable wall mounting system 100 for photographs 130. System 100 includes a ruler 102 and a plurality of frames 104–121. Ruler 102 is configured for easy mounting on a vertical surface 122 such as an inside wall 124 of a house (not shown). Frames 104–121 are mounted at various vertical locations on, and project from, opposite sides 126 and 128 of ruler 102. Frames 104–121 hold a photograph 130, poem, letter, certificate, computer graphic, or other media of a size adapted to fit within frames 104–121. Ruler 102 contains height indicia 132, such as markings indicating vertical height, in inches or centimeters, from a floor 134.

Figure 2:
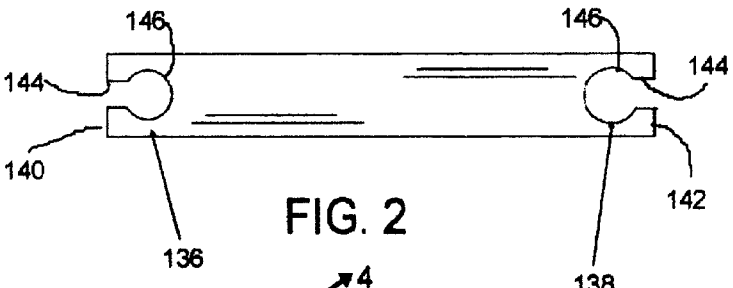
FIG. 2 is a top view of a ruler of the system of FIG. 1.

FIG. 2 is a top view of ruler 102, showing two keyhole-shaped grooves 136 and 138 on the left and right sides 140 and 142, respectively, of ruler 102. A bottom view (not shown) would be similar. Grooves 136 and 138 each have a narrower outer portion 144 and a wider inner portion 146. This "keyhole" configuration of grooves 136 and 138 allows grooves 136 and 138 to receive and retain beaded tabs (described below) of frames 104–121.

Figure 3:
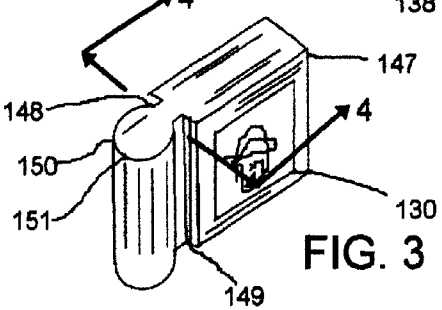
FIG. 3 is a perspective view of a rectangular picture frame of FIG. 1 with a flared tab, the flare being a circular bead.

FIG. 3 is a perspective view of frame 104. Frames 105–121 would be similar and preferably interchangeable left to right and right to left, although some frames could be adapted for left-hand mounting and others could be adapted for right-hand mounting. Frame 104 has a border 147 and tab 148. Tab 148 has a bead 150 at an outer end 151. Tab 148 is slidably received in grooves 136 and 138 with bead 150 disposed within wider portion 146. Bead 150 is a circular bead with a diameter greater than the width of narrower outer portion 144, so that bead 150 cannot pass outwardly through portion 144, thus bead 150 and portion 144 cooperate to retain frame 104 on ruler 102. In essence, tab 148 is outwardly flared, so that when it is placed in a matching inwardly flared groove on an edge of ruler 102, the tab can slide vertically but cannot be pulled laterally out of the groove. Thus, "flared" as used herein does not mean or require continuity of increasing thickness, but merely greater thickness at one end than the other to prevent the lateral pull-out while permitting vertical sliding. The vertical sliding need not be loose, but can have considerable resistance such that the frame does not move on its own without significant added force. This simplifies adjustment. Alternatively, the tab and groove may only be loosely congruent so that additional dowels or other spacers are required to maintain position of the frames vertically on the ruler.

A photographic slot 149 is provided on the inner edge of border 147 so that when ruler 102 is in place the ruler blocks slot 149 and prevents the photographs from coming out of frames 104–121, but this slot could be placed elsewhere on the frame. For example the slot could be on the outer side opposite it shown location so that even when positioned, photographs could still be removed. While that is considered not as aesthetically pleasing, it might be more desirable to some users who do not want to have to remove frames from the ruler to change photographs or other media.

Figure 4:
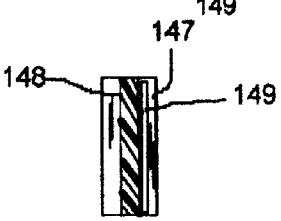
FIG. 4 is a cross sectional view of the frame of FIG. 3, taken along lines 4—4 of FIG. 3.

FIG. 4 is a side cross-sectional view of frame 104 taken along lines 4—4 of FIG. 3 and looking outward. A side cross-sectional view (not shown) of frames 105–121 is, preferably, similar to that for frame 104 although larger or smaller frames could be used, if desired. The location of photographic slot 149 is better shown in FIG. 4, and it is again noted that ruler 102 would cover slot 149 when frame 104 is in place to both hide slot 149 from view and to block removal of photograph 130 from frame 104.

Figure 5:
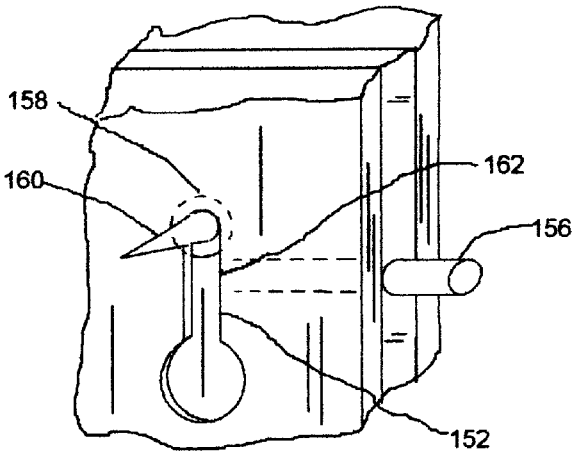
FIG. 5 is a rear view of a fastener head capture system of the ruler of FIG. 2.

FIG. 5 is a rear view of a ruler 102. Ruler 102 has a mounting slot 152 on its rear surface 154. Slot 152 is of the conventional "flanged keyhole groove" type. However, a transverse retainer pin 156 is added to the conventional setup to retain a head 158 of a mounting screw 160 in an upper part 162 of slot 152. Screw 160 would be threaded into wall 124 leaving head 158 exposed. Slot 152 is then placed over head 158 in conventional manner and ruler 102 slid downward to move head 158 into upper part 162. Retainer 156 is then inserted into a retainer hole (not shown) and passed just below and under head 158 to block head 158 from moving downward out of slot 152. Ruler 102 also has a transverse blocking pin 161 (see FIG. 8) near the bottom or lower end of grooves 136 and 138 in order to prevent frames 104–121 from falling out the bottom of grooves 136 and 138. Any other blocking device could be substituted, such as a bottom plug, bottom cap or even a wad of gum, as the purpose of the blocking device is to block the lower end of grooves 136 and 138. Of course, the blocking device should not be unsightly and it is preferably removable and reusable. A similar blocking pin (not shown) or blocking device could be used at the upper end to prevent kids from pulling the frames upwardly out of grooves 136 and 138. A locking pin (not shown) of any suitable conventional design could even be used as blocking pin 161 for added security.

Figure 6:
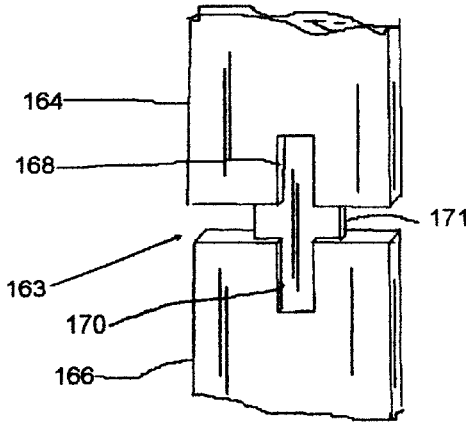
FIG. 6 is a rear view of a tongue and groove connector for upper and lower portions of the ruler of FIG. 2.

FIG. 6 is a rear view of a connector 163 for connecting an upper part 164 of ruler 102 to a lower part 166 of ruler 102. Connector 163 comprises a pair of aligned flange grooves 168 and 170 in upper part 164 and lower part 166, respectively, and a flat or flanged or +-shaped bar 171 configured to be inserted into, and preferably fill, grooves 168 and 170 to hold upper part 164 onto lower part 166. Ruler 102 could be made as a single tall ruler, but connector 163 allows ruler 102 to be split into upper parts 164 and lower parts 166 in order to facilitate easier packaging and transportation. Upper part 164 and lower part 166 are preferably three feet long. This allows part 164 and part 166 to be used as standard yardsticks in the event the customer ever tires of having a growth chart photograph mounting system. Other lengths could be used, also.

Figure 7:
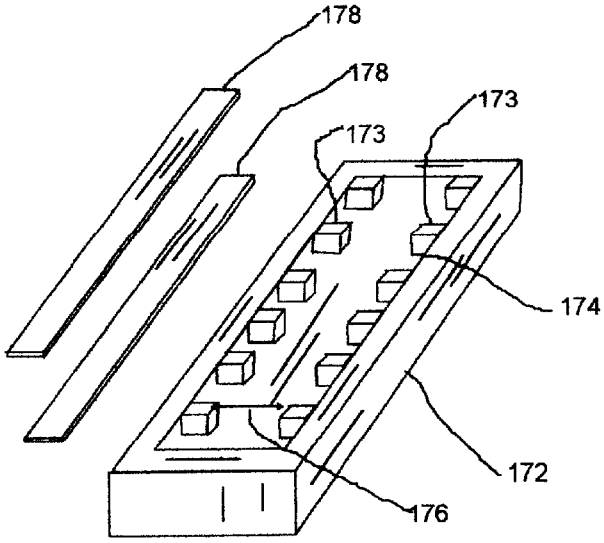
FIG. 7 is a top perspective view of a transportation and display box for the system of FIG. 1.

FIG. 7 is a top perspective view of a transportation and display box 172 for system 100. Box 172 is a rectangular box containing a plurality of equally spaced vertical internal divider tabs 173 on an inner wall 174 of box 172. Dividers 173 are aligned across from each other on inner wall 174 so as to provide a plurality of pockets 175 for frames 104–121. The lateral distance 176 between dividers 173 is approximately equal to the width of ruler 102, so that ruler 102 is firmly held within space 176 and between dividers 173. Cloth, plastic, paper or other dividing sheets 178 are preferably placed between parts 164 and 166 and frames 104–121 during initial transportation to the customer to prevent premature scratching of the surface of growth chart system 100, although that is an option that could be eliminated without departure from the invention claimed below. Likewise, while a wooden style display box is shown in FIG. 7, a cardboard, metal, plastic or other material box (not shown) of any suitable style could be used to hold system 100 or any of the alternate systems described above or below, if desired.

Figure 8:
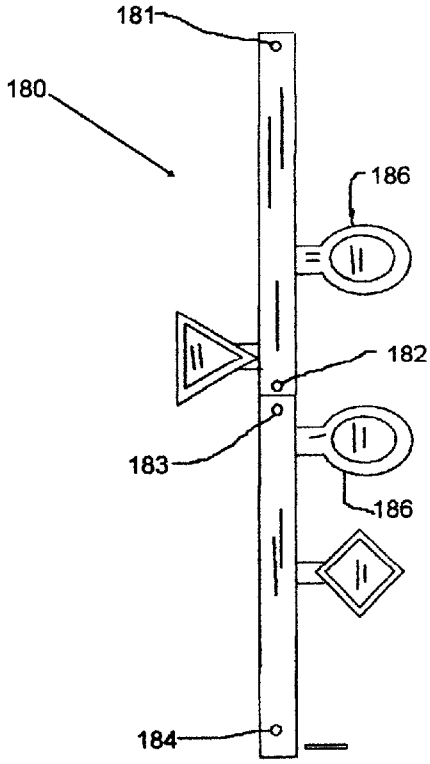
FIG. 8 is a front view of an alternate direct fastening wall mounting system for the ruler of FIG. 1, with oval photographic frames.

FIG. 8 is a front view of an alternate wall mounting system 180 for photographs, in which upper and lower parts 164 and 166 are configured with screw holes 181,182 and 183,184, respectively, so that four conventional screws can be used to fasten ruler 102 on wall 124. Mounting system 180 has oval frames 186, instead of square frames 102, and this poses no particular problems. Tabs 188 are substituted for tabs 148. Tabs 188 on frames 185 are configured with a flat portion 193 having rectangular bead 194 to show that it is not necessary to have a circular bead. Grooves 136 and 138 would be replaced by grooves with rectangular inner portions (not shown). Other suitable matching grooves and beads could be used instead providing the tabs have a bead or other larger thickness equivalent to prevent the frames 186 from falling out of the ruler.

Figure 9:
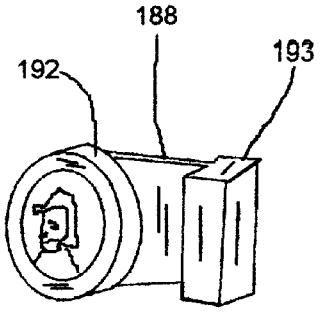
FIG. 9 is a perspective view of an alternate upright oval picture frame with a flared tab, the flare being a square bead.

FIG. 9 is a perspective view of an oval picture frame 192, with a rectangular bead 194 to further emphasize the possibility of using alternate shapes for in place of exemplary beads 150 and exemplary grooves 136 and 138.

Figure 10:
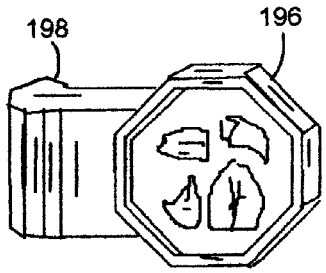
FIG. 10 is a perspective view of an alternate polygonal frame with a flared tab, the fare being a polygonal bead.

FIG. 10 is a perspective view of a polygonal frame 196 with a polygonal bead 198, to show that yet other bead configurations are possible.

Figure 11:
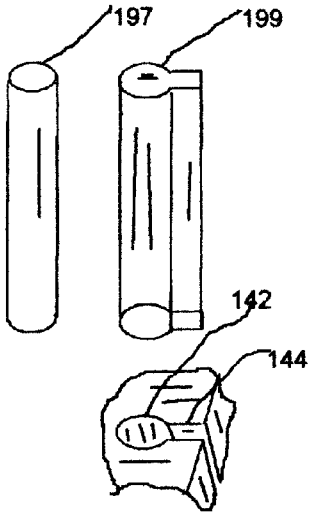
FIG. 11 is a perspective view of an upper side portion of the ruler of FIG. 1, showing a spacer dowel ready to be installed.

FIG. 11 is a perspective view of a top portion of ruler 102 showing use of a pair of exemplary spacing dowels, ribbed spacing dowel 199 and unribbed spacing dowel 197 to hold adjacent frames 104–21 at any desired spacing relative to each other. Ribbed spacing dowel 199 is configured to give a flush fit with both inner portion 144 and outer portion 142 of grooves 136 and 138. Dowel 197 is a standard round dowel cut to any desired length. Dowel 197 or 199 is inserted into groove 136 or 138 to produce any desired spacing between adjacent frames 104–121. In order to use a standard circular dowel as dowel 199, it is preferably that inner portion 144 be of circular cross-section.

Figure 12:
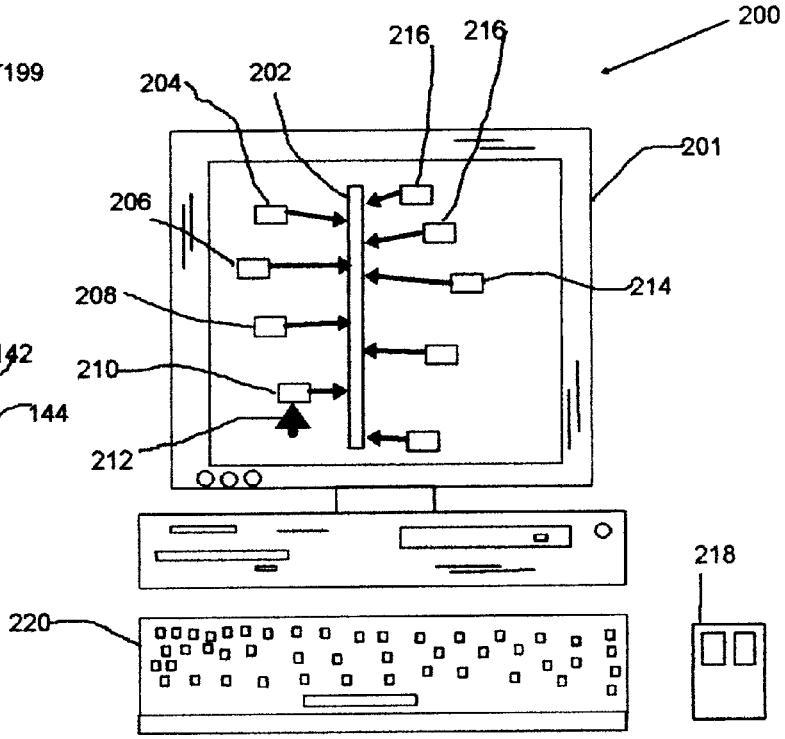
FIG. 12 is a perspective view of a virtual growth chart simulating the growth chart system of FIG. 1, but with added features.

FIG. 12 shows a virtual photographic mounting system 200, which could be programmed in known fashion with digital images (described below) on a monitor 201 to give an online simulation of the system 100 of FIGS. 1–11.

In use, ruler 102 could be 60 inches long and 3 inches wide, with markings in both centimeters and inches. Alternately, ruler 102 could be just in inches or just in metric units. Since babies are usually more than 24" tall by the time they begin to stand, the bottom of ruler 102 could be placed a foot or more above the floor and this would allow ruler 102 to be used on walls that have base moldings without having to remove, cut or otherwise modify the base moldings. Ruler 102 could ultimately be made about 1 in. wide like a standard yardstick, if that was the user's desire. More commonly, however, the user would want a wider ruler in order to differentiated from a standard yardstick and to allow use of additional markings on the ruler. Ruler 102 would first be assembled by inserting bar 171 into grooves 168 and 170 to hold upper part 164 onto lower part 166. Ruler 102, thus assembled, would be turn backwards and placed on wall 124 and a mark made on wall 124 at the desired location of upper part 162. Mounting screw 160 is then screwed into the wall 124 at the mark with head 158 projecting outwardly from wall 124 Slot 152 is then placed over head 158 in conventional manner and ruler 102 slid downward to move head 158 into upper part 162. Retainer 156 is then inserted into a retainer hole (not shown) and passed just below and under head 158 to block head 158 from moving downward out of slot 152. Blocking pin 161 would be inserted in lower part 166, if not already there, to prevent frames 104–121 from dropping out the bottom of grooves 136 and 138. One or more dowels 199 or other specially shaped dowels (not shown) conforming fully to grooves 136 and 138 or other shaped groove (not shown) of a desired height would then be place in groove 136 or 138 and slid down into contact with pin 161. One or more of picture frames 104–121 would then be attached to ruler 102 by inserting bead 150 into the top of groove 136 or 138 and sliding that frame or frames down into contact with dowel 199 to position that frame 104–121 at the desired height. Another dowel 199 of the same or different length would then be inserted into groove 136 or 138 to set the height of a second collection of one or more of frames 104–121 and that second collection would be lowered into position in similar manner to that previously described. The process would then be repeated until the desired number of frames 104–121 was positioned properly. Process would be reversed to remove one or more of frames 104–121 from ruler 102.

FIG. 12 shows a customized graphical user interface ("GUI") in the form of a virtual photographic mounting system 200. System 200 provides a computer simulation of the above-described physical mounting system 100, although tabs and slots are replaced by graphical location systems of conventional design such as image boxes or text boxes. In virtual mounting system 200, a monitor 201 is caused to display one or more virtual ruler images 202 along with digital media images 204. Images 204 are associated by arrows or lines leading to height indicia 206, 208, 210 on image 202. A cursor 212 is placed over a selected digital image 204 to activate a hyperlink 214 or "cursor over" or "click on" or other activating feature to produce a desired response. The link could even be the height indicia 206, with the image 204 hidden until the cursor is placed on the height indicia. Digital photographs 216 are "inserted" into digital images 204 placed at associated heights on virtual ruler image 202. System 200 allows association of a wide variety of digital images 204 with selected heights on ruler 202, such as video clips, audio clips, written documents, copies of certificates, links to web pages or websites, all keyed to various heights of a child. In system 200, the height indicia 206 could be replaced by other indicia such as age or residential locations. The variability of graphical representation which computer programs are able to display and the ability to use hyperlinks, drop down menus or other hidden commands and initially hidden features and displays allows a great variety of presentations, all within the overall context of a graphical display keyed to indicia of a person's life or career. However, the computer rendition of virtual mounting system 200 still contains the basic concepts of growth chart monitoring system 100. A mouse 218 or keyboard 220, or voice command or any other current or future control or command method can control the display on monitor 201. The physical descriptions given above in FIGS. 1–11 and any claims below are to be understood to also include their virtual equivalents. The virtual equivalents can achieve electronically the same general visual impression or results by adjustably linking data to a scale in substantially the same way with substantially the same visual structure, and substantially the same basic visual results although the virtual system can be more robust and more quickly, extensively and easily modified, easily saved and easily duplicated for a variety of persons. The physical system 100 is intended to produce a given visual result, and will have a more tangible touch and feel desirable to many users. The virtual system 200 can produce a more robust simulated duplicate of that visual result to those who prefer computer simulations to allow for added features. The desired mental image is thus achieved whether the system is physical or virtual.

The above description is provided to fulfill the statutory duties of enablement and best mode disclosure. However, it will be understood from the alternate physical and virtual systems disclosed above that various modifications could be made in the constructions and methods herein described and illustrated without departing from the scope of the invention, and that different users will have different views of which embodiment is best. By way of further example, while an exemplary vertical ruler, which is the best mode known to the inventor at the time this specification is filed, is shown in the drawing, the ruler could be oriented in any desired position and could measure any desired criteria. For example, and to make the point of the wide variety of embodiments possible, another exemplary embodiment could be 20 feet wide or more and 100 yards long or more and be mounted on the inside of the roof of an NFL domed stadium or NBA arena and have photographs or banners depicting historic accomplishments of the home team in frames mounted along the side. Or, alternatively, a vertical or inclined ruler could be mounted in a baseball outfield seating section to show the distance or height over the wall of historic home runs. Similarly, a ruler could be mounted near an Olympic event, such as a ski long jump, to show historic record jumps. A vertical ruler could be used at a fundraiser to show historic results of past fundraising campaigns or current milestones. So, while a specific "growth chart" is shown in the drawings, there are many other uses for and embodiments of the invention within the scope of the claims. Accordingly, a wide range of equivalents exists to the term "growth chart" and all other terms used in the following claims. All matter contained in the foregoing description is illustrative and exemplary rather than limiting. Thus, the breadth and scope of the present invention should not be limited by any of the above-described exemplary embodiments, but should be defined only in accordance with any claims appended hereto and their broad equivalents interpreted as broadly as is possible while still distinguishing from the prior art.

Any patents referenced herein are incorporated in their entirety for purposes of background information and additional enablement.

What is claimed is:

1. A growth chart system, comprising:

a ruler with an inwardly flared tab slot in a side of said ruler, said tab slot extending along a major portion of said side of said ruler; and a plurality of visual media holders, each having an outwardly flared tab at least loosely fitting within said tab slot, the maximum thickness of said tab being greater than the minimum width of said tab slot, so as to prevent said tab from being pulled laterally out of said tab slot but selectively allowing longitudinal sliding of said tab within said tab slot and thus selective sliding of said media holders along said sides of said ruler;

wherein a rear portion of said ruler is recessed to define a flanged keyhole type groove and wherein said system includes a transverse retainer pin movable transversely across said keyhole groove configured to releasably lock a fastener head in said keyhole groove.

2. A system in accordance with claim 1 further comprising a second tab slot on an opposite side of said ruler from said first tab slot, said second tab slot extending along a major portion of opposite side of said ruler.

3. A system in accordance with claim 2 wherein said tab slots are of equal length.

4. A system in accordance with claim 1 wherein said ruler is vertical.

5. A system in accordance with claim 1 wherein said flared tab is discontinuously flared.

6. A system in accordance with claim 5 wherein flaring of said tab is provided by a bead at an outer end of said tab.

7. A system in accordance with claim 6 wherein said bead is circular in cross section.

8. A system in accordance with claim 6 wherein said bead is non-circular.

9. A system in accordance with claim 1 wherein said ruler comprises separate upper and lower portions, a fastener configured to releasably connect said portions and an aligner configured to align said tab slots of said upper and lower portions to form tab slots extending along both said upper and lower portions.

10. A system in accordance with claim 9 wherein said fastener and aligner device are a single element.

11. A system in accordance with claim 9 wherein the fastener is a tongue and said aligner is a groove.

12. A system in accordance with claim 11 wherein the tongue is a flanged bar.

13. A system in accordance with claim 9 wherein the fastener and aligner are on a rear surface of said ruler so as to be hidden when the system is mounted for normal operation.

14. A system in accordance with claim 1 wherein said visual media holders are photographic frames.

15. A system in accordance with claim 14 wherein said photographic frames have a photographic slot adjacent said tab, said photographic slot being obstructed and hidden by said ruler when said tab is located in said tab slot.

* * * * *